United States Patent [19]

Eisermann

[11] Patent Number: 5,012,659

[45] Date of Patent: May 7, 1991

[54] LOCKING DEVICE WITH KEY-CODED PRINTER CONNECTION

[75] Inventor: Armin Eisermann, Velbert, Fed. Rep. of Germany

[73] Assignee: Schulte-Schlagbaum Aktiengesellschaft, Velbert, Fed. Rep. of Germany

[21] Appl. No.: 458,713

[22] PCT Filed: Jun. 9, 1989

[86] PCT No.: PCT/EP89/00650

§ 371 Date: Feb. 9, 1990

§ 102(e) Date: Feb. 9, 1990

[87] PCT Pub. No.: WO89/12155

PCT Pub. Date: Dec. 14, 1989

[30] Foreign Application Priority Data

Jun. 11, 1988 [DE] Fed. Rep. of Germany ..... 3819955

[51] Int. Cl.[5] ..... E05B 47/00

[52] U.S. Cl. ..... 70/276; 70/277

[58] Field of Search ..... 70/276, 277, 278; 340/825.3, 825.31

[56] References Cited

U.S. PATENT DOCUMENTS 3,732,542 5/1973 Hedin ..... 340/149 A
4,591,852 4/1984 Brod .
4,727,369 2/1988 Rode .
4,918,957 4/1990 Eisermann ..... 70/276
4,932,228 6/1990 Eisermann ..... 70/276

FOREIGN PATENT DOCUMENTS 0132627 6/1984 European Pat. Off. .
2595744 9/1987 France .

*Primary Examiner*—Robert L. Wolfe
*Attorney, Agent, or Firm*—Martin A. Farber

[57] ABSTRACT

An electronic locking device consisting of a lock and key cards and the lock electronics of which has a data storage and which can be coupled with a mobile printer which can be connected to the lock electronics and retrieve data, the locking device having an insert shaft for the key cards in which shaft a card reader is arranged and which shaft is provided at its end with a socket device connected to the lock electronics for a card-shaped coupling element of the printer which can be inserted into the insert shaft and has electrical contacts. For improved protection against unauthorized reading of data, the invention proposes that the coupling element (9) have a key-card code, and that a slide which can be displaced by the coupling element (9) upon insertion thereof be present in the insert shaft (4), which slide can be fixed in position by tumblers which are transferred into the release position in case of a valid key-card code and thus permit displacement of the slide into its end position in which the contacts come into engagement with the socket drive (49).

11 Claims, 7 Drawing Sheets

FIG. 6
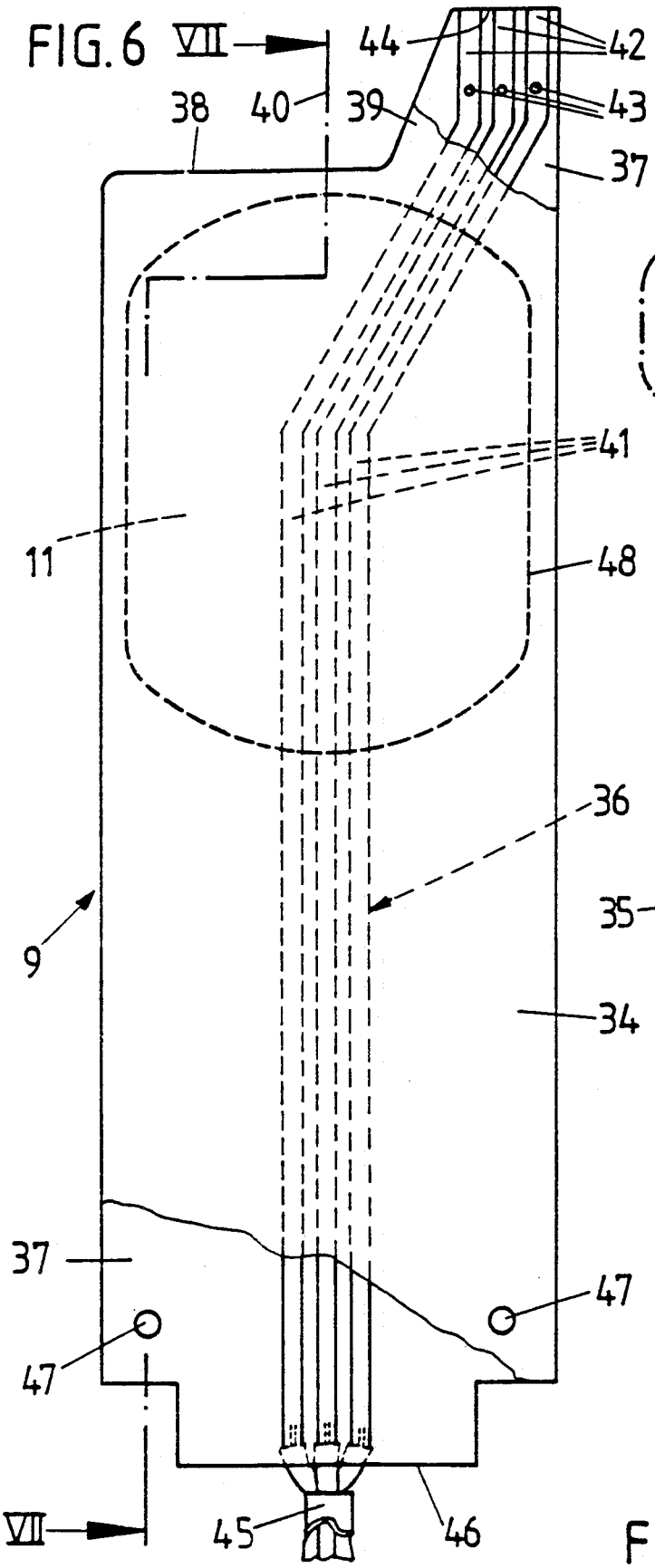
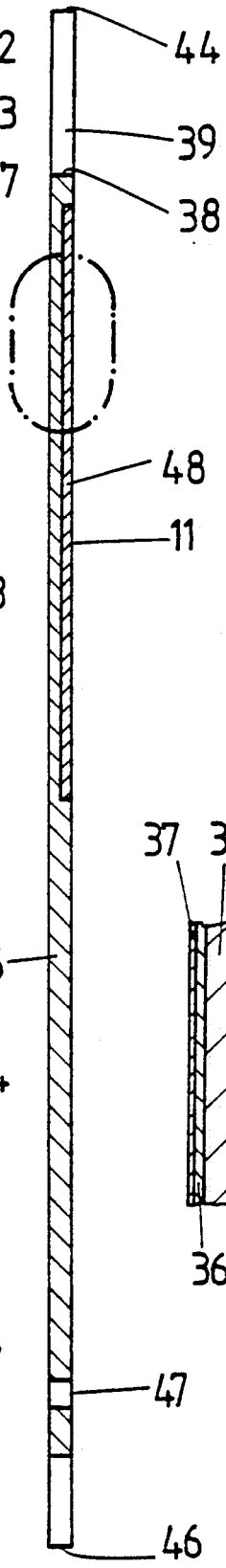
FIG. 7
FIG. 8
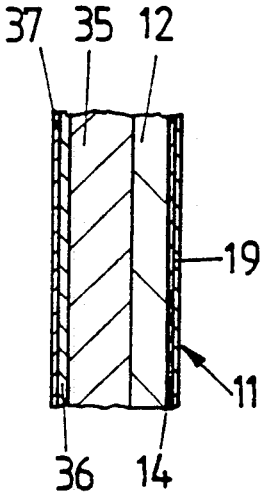

LOCKING DEVICE WITH KEY-CODED PRINTER CONNECTION

FIELD AND BACKGROUND OF THE INVENTION

The present invention relates to an electronic locking device which consists of a lock and key cards, the lock electronics of which has a data storage and which can be coupled with a mobile printer which can be connected to the lock electronics and retrieve data, the locking device having an insert shaft for the key cards in which a card reader is arranged and which is provided at its end with a socket connected to the lock electronics, for a card-shaped coupling element of the printer which can be inserted into the insert shaft and has electrical contacts.

Such a locking device is known from European Patent 132 627. By utilizing the insert shaft both for inserting the key cards and for the coupling element, a particularly clear and simple construction has been created since a separate insert opening for the connection to the mobile printer is unnecessary. Furthermore, as a result hereof, a concealed arrangement of the socket is made possible, which offers a certain protection against unauthorized manipulation. Nevertheless, in the known arrangement it cannot be excluded that unauthorized access to the data storage of the lock takes place in the manner that an unauthorized person inserts a coupling element into the insert shaft of the lock and in this way establishes an electrical connection with the receptacle. Status data can thus be interrogated or printed out by the mobile printer, indicating with what key cards and at what time a locking of the lock took place, whether the key card was merely inserted or whether the lock mechanism was also actuated, and whether there were any malfunctions of the lock. The retrievable information is customarily up-to-date, i.e. an up-to-date data base is maintained which continuously writes over older data. It is readily understood that the retrievable data should be accessible only to authorized persons.

The connection of the printer constitutes a special operating mode of the lock; in normal operation (access control operation) a query for the coding and a comparison with the lock code take place upon insertion of a valid key card into the insert shaft. If the key-card information enquired for corresponds to the values stored in the memory, then a locking pulse is produced which makes the transfer of the lock into release position possible. Such locking devices can thus be used wherever access to certain areas is to be permitted only for authorized persons.

SUMMARY OF THE INVENTION

Based on the above-described problems, a locking device of the type indicated above is disclosed with which the retrieval of data by unauthorized persons is made substantially more difficult.

This object is achieved, in accordance with the invention, in the manner that the coupling element has a keycard code and that a slide which is present in the insert shaft, can be displaced with the coupling element upon insertion thereof and can be fixed in position by tumblers which, upon a valid key-card code, are transferred into the release position and thus permit displacement of the slide into its end position in which the contacts come into engagement with the socket device. It is thus proposed in accordance with the invention that coupling with the socket device can only be effected when the coupling element has a valid key-card code. If a conventional coupling element which is known from the prior art is inserted into the insert shaft of the lock of the invention then a connection with the socket device cannot take place since displacement of the slide is impossible due to the lack of key-card coding, so that the contacts cannot reach the socket device. Thus in accordance with the invention a mechanical blocking of the coupling element is present if the latter is not provided with a valid key-card code. Furthermore, the key-card code can also be a special key-card code which as special code, in contrast to the customary key-card codes, controls the lock electronics in such a manner that it supplies the data desired. If only the "customary" key-card code is present, then the transmission of the data is blocked.

European Patent Application 24 242 discloses, in principle, a mechanically/magnetically operating lock in which tumblers are displaceable by means of magnetized areas of the corresponding key-cards, the tumblers releasing a slide which, in the end position of its displacement, leads to the releasing of the lock mechanism. This construction, however, has no "memory"; there are no lock electronics whatsoever, so that no information concerning previously effected lockings can be retrieved. In the case of the magnetic code it is, however, not possible - in accordance with the disclosure of EP 24 242 - to derive corresponding data from it and store them in a memory since the magnetized areas serve exclusively for the tumbler displacement.

In accordance with a further development of the invention it is proposed that the coupling element have conductive path coatings which form the contacts on one lateral edge of the coupling element, extend essentially up to the opposite lateral edge of the coupling element while passing by the key-card code, and are connected there to a cable leading to the printer. While in the object of EP 132 627 the conductors which are developed as wires lead to a separate plug attached to the coupling element and therefore build up correspondingly the depth of the coupling element, the object of the invention proceeds in an entirely different manner which permits a very flat construction. Compared with insulated lines, conductive path coatings are much thinner and therefore practically do not increase the thickness at all. Furthermore, the end regions of the conductive path coatings themselves form the contacts so that, on the one hand, a separate plug element can be dispensed with and, on the other hand, no thickness-increasing measures are taken in the contact region either. The plug element known from the prior art, however, leads to a correspondingly thicker construction which can lead to jamming or even damaging of the corresponding devioes in the insert shaft. In particular, the card reader is in danger there. Such a development of the prior art (but without excluding the danger of damage) is conceivable with light scanning, as realized in the object of EP 132 627. However, if tumbler control is effected —as will still be described below —by means of magnetized areas of the coupling element, then operability becomes questionable when using insulated cables and a plug element since these parts would lead to a relatively large distance of the card from the tumblers, so that the magnetic forces are reduced corresponding to the distance and no longer permit dependable tumbler displacement. It must be taken into account in this connection that the magnetic forces decrease disproportionately with an increase in the distance. Furthermore, in the object of the invention a crossing of the key-card code by the conductor paths is realized, which is a special feature, in particular upon use of a magnetic code, since the inventor has recognized that the magnetic fields of the currents passing through the conductor paths do not result in falsification of the magnetic code. On the other hand, the magnetized areas do not interfere with the conductive path currents.

The arrangement can be such that the contacts are arranged on a longitudinal extension of the coupling element. Accordingly, the lower edge of the card can be used for the displacement of the slide, the possibility of a connection with the socket device nevertheless being present. It is particularly advantageous in this connection if the longitudinal extension is developed on one side of the longitudinal central plane of the coupling element so that a slide displacement can be effected by the central region of the coupling element, which is a protection against canting, and the socket device can furthermore be arranged in a lateral region, which is advantageous for reasons of space.

The coupling element has, in accordance with a further development of the invention, a printed circuit board on the one broad side of which the coding substrate of a key-card is arranged. This construction has special advantages since, from the large number of valid key codings of the locking device, a specially desired one can be selected and its coding substrate can be attached on the broad side of the coupling element. The key-cards and the coupling element have the same dimensions of width and thickness so that in this manner one and the same coding device which is adapted to the corresponding dimensions can be used for producing the coding. Thus, no special apparatus for coding the coupling element is required.

It is advantageous for the coding substrate to be inserted in a recess in the broad side of the printed circuit board. In this case, the arrangement does not increase in thickness and it can be seen to it, in particular, that the surface of the coding substrate is aligned with the surface of the printed circuit board.

At least a part of the key-card code is preferably formed by magnetized regions. The tumblers, which are developed as magnetic pins, can be controlled by these magnetized regions. Another part of the key-card code is formed by a bar code. This bar code is read by the card reader so that the corresponding data pass in this manner to the memory and can be entered there.

Particularly high security is assured if —in accordance with a further development of the invention —the bar code read by the card reader effects the control of that tumbler or those tumblers which can, in each case, be brought into the release position by the magnet coil which can be excited by the card reader. Accordingly, the tumbler release is effected not solely by the magnetic code but also, in combination therewith, by the bar code, so that the bar code assumes a double function in the manner that it effects, in addition to the tumbler displacement, also the feeding of the desired data.

One advantageous construction is characterized by the fact that the slide has bearing recesses on the slide surface thereof which rests on an apertured plate attached to the lock case, tumblers developed as magnetic pins resting displaceably in said bearing recesses, and that the holes in the apertured plate are aligned with the bearing recesses in the basic position of the slide. A ferro-magnetic plate assures that the magnetic pins, when the coupling element is not inserted, are attracted in such a manner that they establish a coupling between the perforated plate and the slide. If the coupling element with its magnetized regions is inserted so that the same poles of the magnetic points and magnetic pins are opposite each other, then the magnetic pins are forced back and the slide is released.

BRIEF DESCRIPTION OF THE DRAWINGS

The drawings illustrate the invention with reference to one embodiment:

FIG. 6 is a top view of the coupling element, partially broken away, FIG. 7 is a longitudinal section through the coupling element along the line VII —VII of FIG. 6, FIG. 8 is an enlarged longitudinal section through the coupling element in the region of its coding, which is encircled by a dash-dot line in FIG. 7.

DETAILED DESCRIPTION OF THE PREFERRED EMBODIMENT

Figure 1:
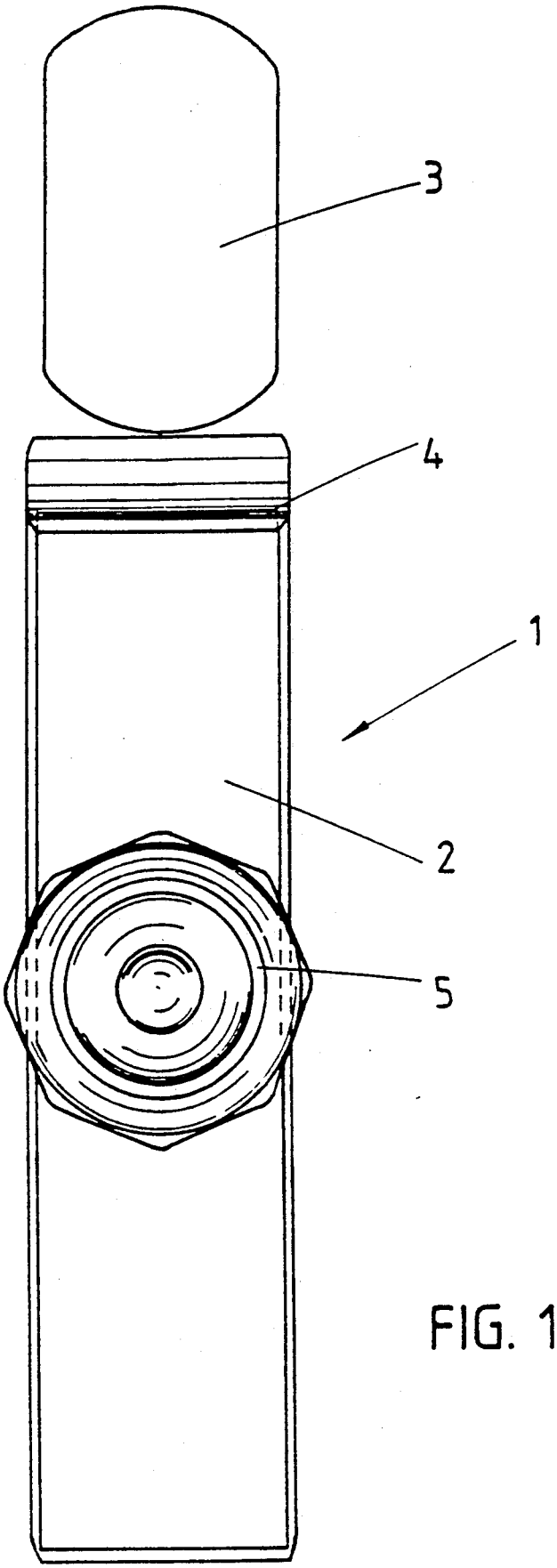
FIG. 1 is a top view of a locking device consisting of lock and key-card.

FIG. 1 shows the locking device 1 of the invention, consisting of a lock 2 and at least one key-card 3. The housing of the lock 2 is provided with an insert shaft 4 into which the key-card 3 must be inserted in order to release the locking mechanism. If the key-card 3 has a valid coding then a coupling of a bolt-actuating shaft with an actuating knob 5 is effected so that bolt displacement can take place.

Such locks 2 are operated with a large number of keycards 3, the individual key-cards 3 being always issued to persons authorized to have access, so that only such persons have access to a control area or the like locked off by the lock 2. It is proposed in this connection that the lock 2 have, in the region of its insert shaft 4, a card reader 6 which reads at least part of the key-card code 7, as a result of which there is the possibility, in addition to verifying the lock authorization, of transferring key-card data into a memory 7' of a lock electronics 8. The memory 7' then stores special information concerning the key number, the system number, the date and hour of locking, the carrying out of the locking process (whether the key card was merely inserted or whether the lock mechanism was also moved) and values as to whether malfunctions have occurred. The storing of a desired number of previously effected lockings is possible, in which connection the contents of the memory will always be updated by writing the latest data over the oldest.

In order to have access to the data stored, a connection between the lock 2 and a corresponding listing device must be established. This listing device is preferably developed as a mobile printer. By means of a coupling element 9 which is inserted into the insert shaft 4 of the lock 2, a data transmission path can be created between the lock electronics 8 and the printer used so that the desired information can be printed out by the printer. The construction of the essential components of the lock and of the coupling element 9 which is provided with a connecting cable leading to the printer is described below.

Figure 2:
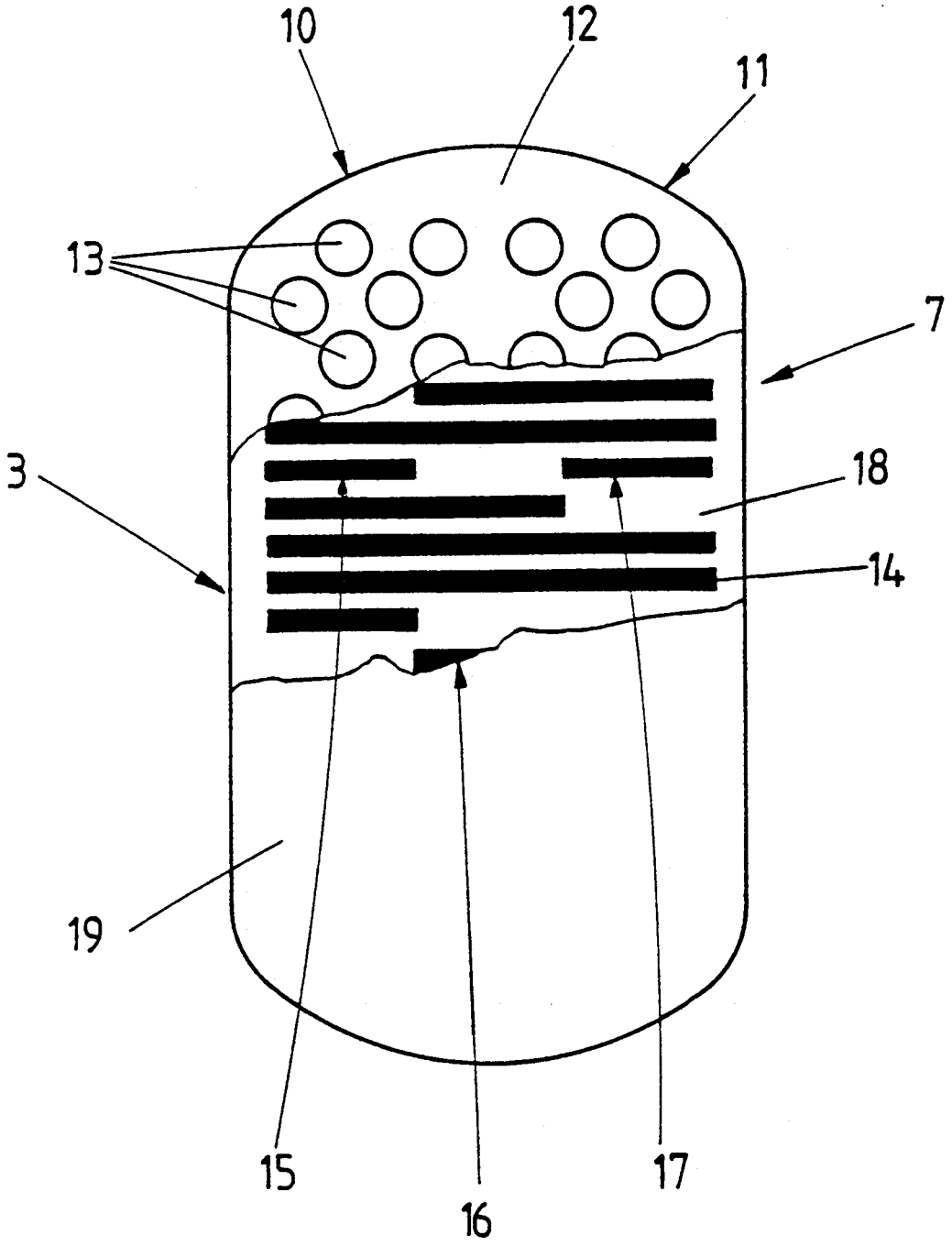
FIG. 2 is a key-card in a partially broken-away view.

FIG. 2 shows —in partially broken away view —the development of the key-card 3, which consists essentially of two components. One component is the support material 10 of the key-card 3, which consists preferably of a suitable plastic. The second component is formed by a coding substrate 11 which is applied to the support material 10 and makes it possible to individualize the key-card 3.

The following description of the development of the keycard 3 is realized, with respect to the coding substrate 11, also in the case of the aforementioned coupling element 9 which will be taken up in further detail below.

A barium ferrite coating 12 is applied to the card-shaped plastic supporting material 10 of the key-card 3, which coating can be magnetized by means of a device (not shown) so that magnetic regions 13 which are provided with a north and south pole can be developed. These magnetized regions 13 have permanent magnetism and form part of the keycard code 7. Above the barium-ferrite coating 12 there is arranged a bar code 14 which consists preferably of three tracks 15, 16 and 17 extending parallel to each other. The bar code 14 has bars of uniform width which, viewed in the longitudinal direction of the tracks, are uniformly spaced from each other unless empty places 18 are formed between them. The bar code 14 is covered by a film 19 which is transparent to infrared radiation. In accordance with one preferred embodiment, it can also be provided that the bar code 14 is printed on the inner surface of the film 19, i.e. the bar code 14 is applied by screen printing on this side of the film 19. For the human eye, the film 19, seen from its outside, has a black color, i.e. it is not transparent. The card reader 6 of the lock 2, however, operates with infrared radiation and can therefore penetrate the film 19 in order to scan the bar code 14.

Figure 3:
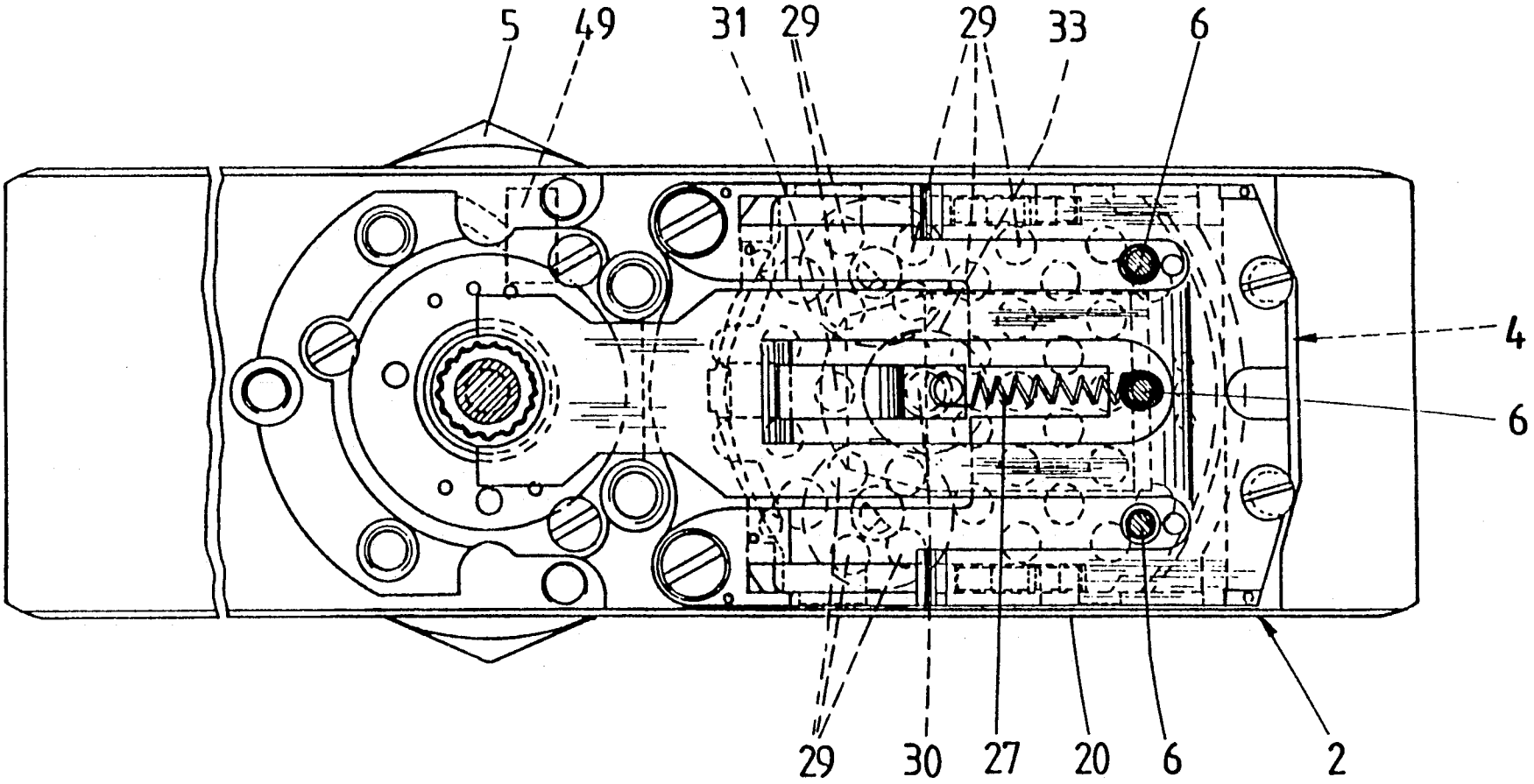
FIG. 3 is a rear view of the lock, without insertion of the coupling element.
Figure 4:
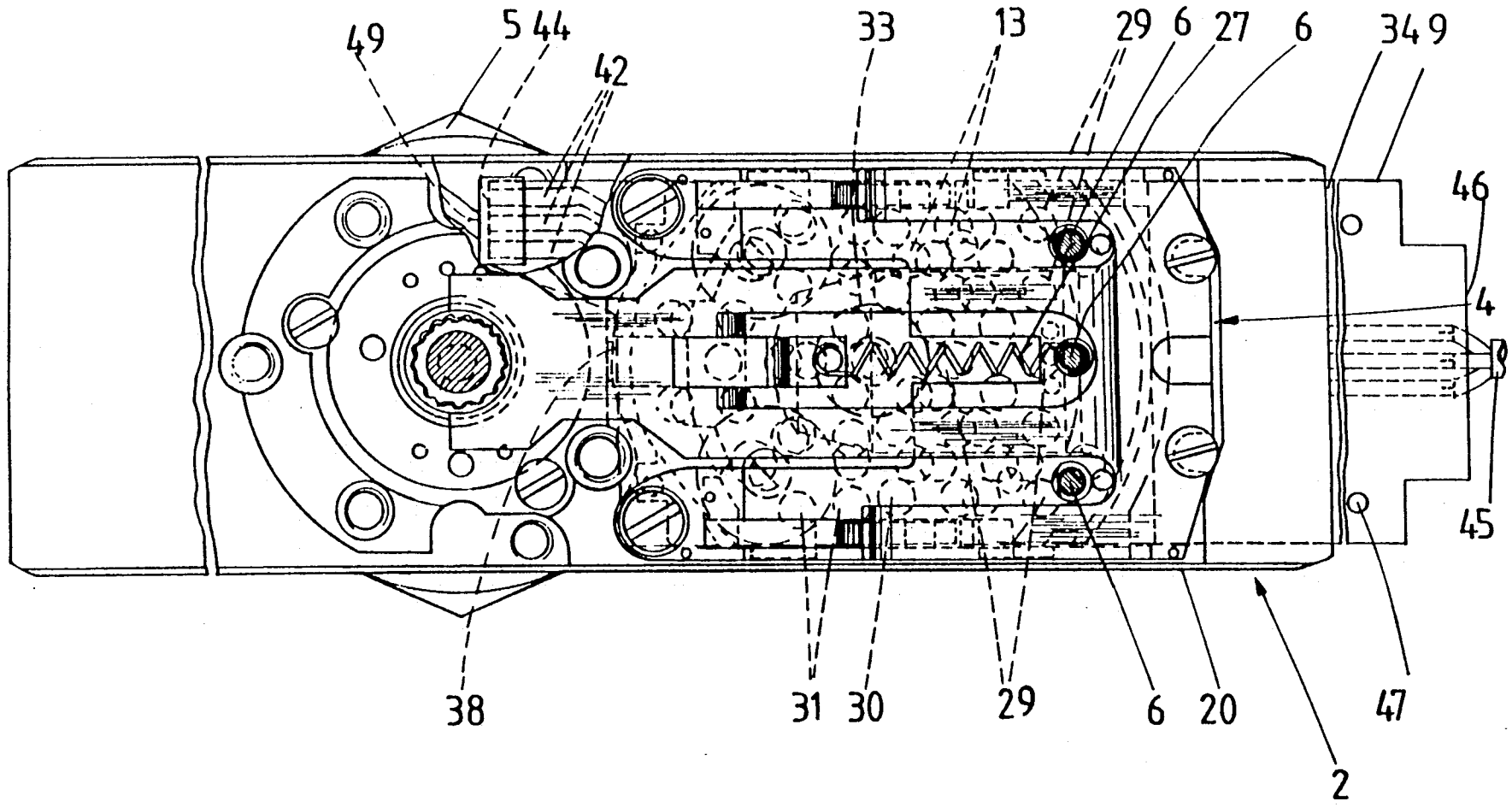
FIG. 4 is a view according to FIG. 3 but with the coupling element inserted.
Figure 5:
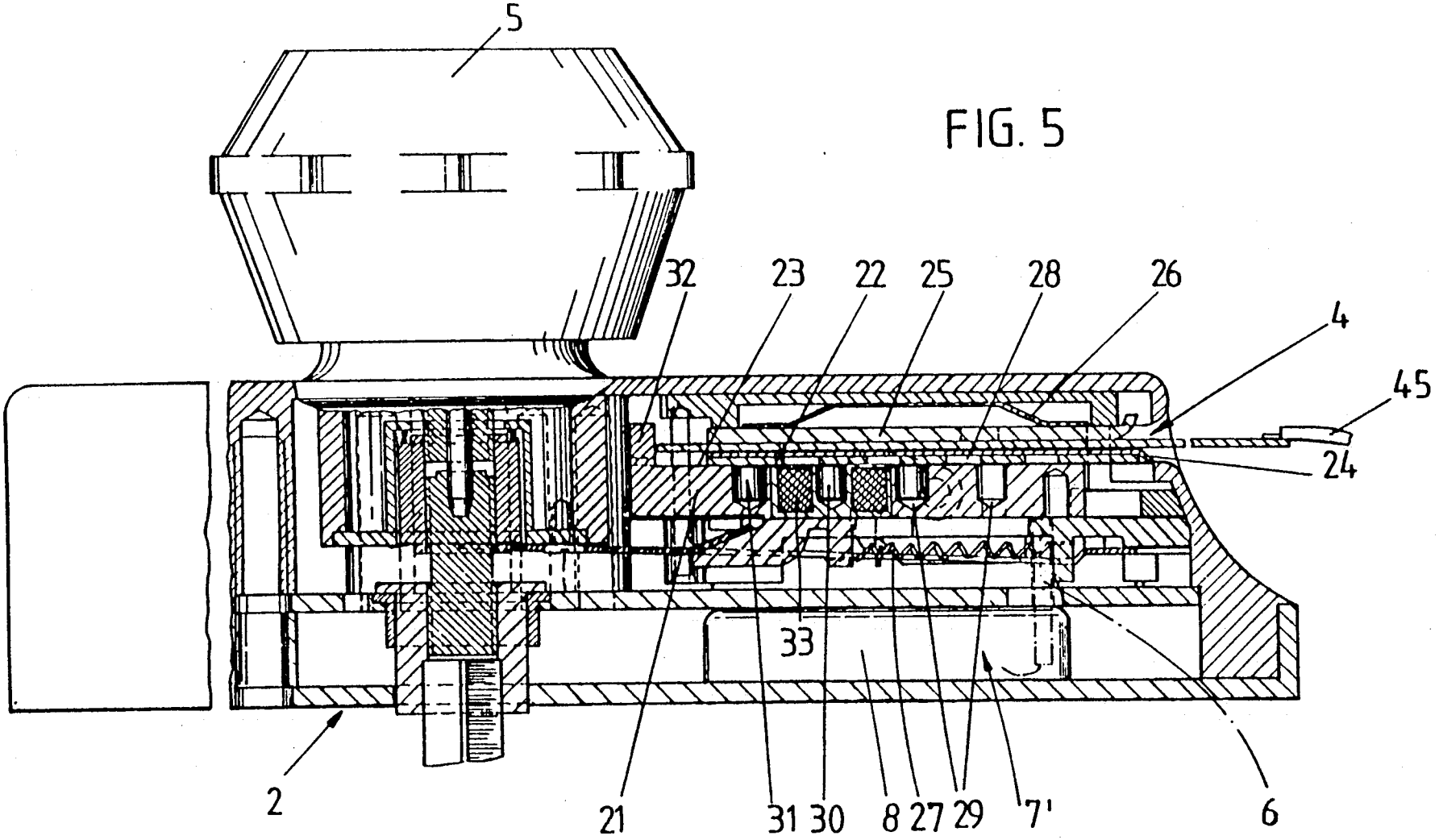
FIG. 5 is a side view of the showing of FIG. 4.
Figure 9:
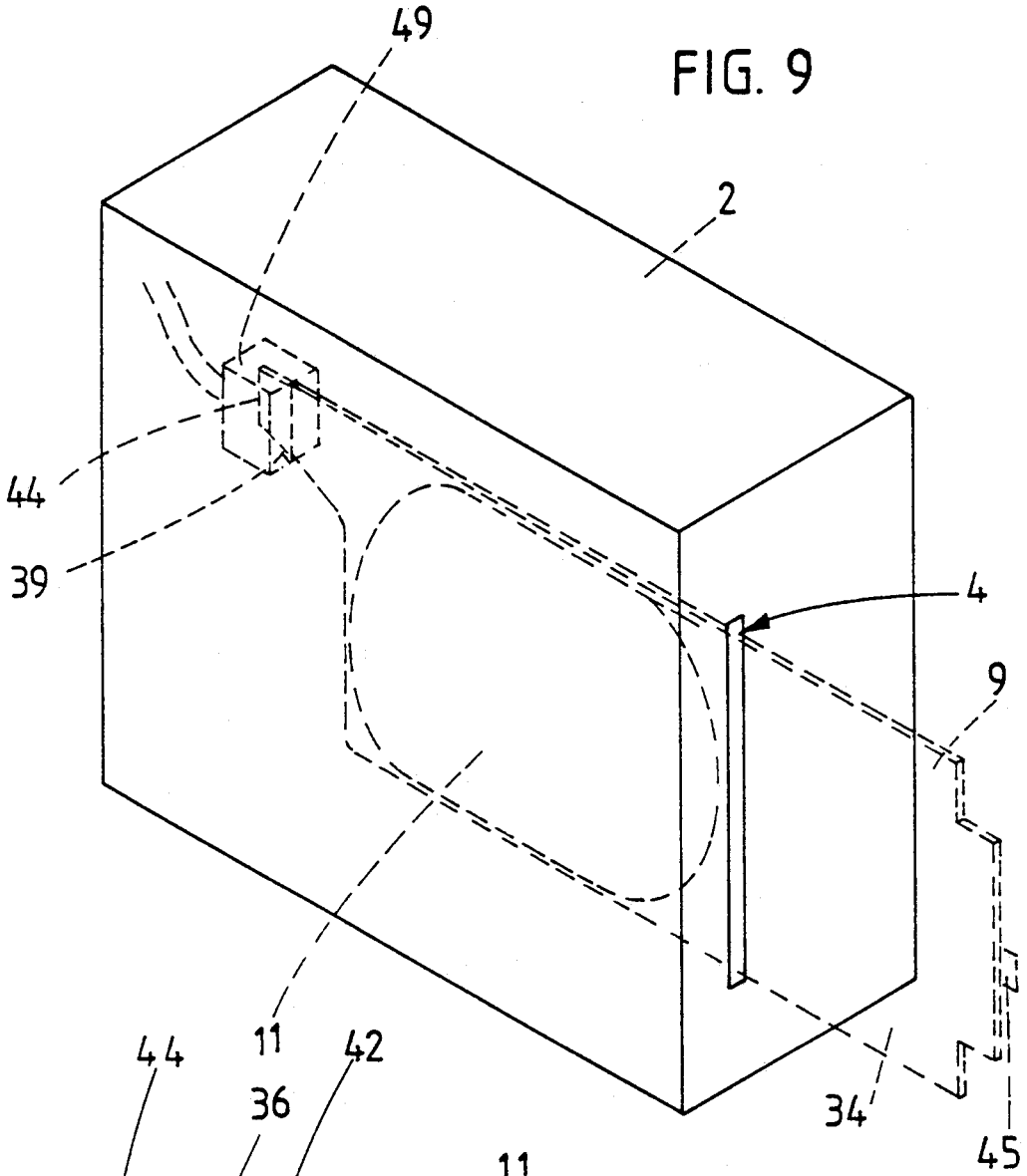
FIG. 9 is a diagrammatic view of the locking device with the coupling element inserted.
Figure 10:
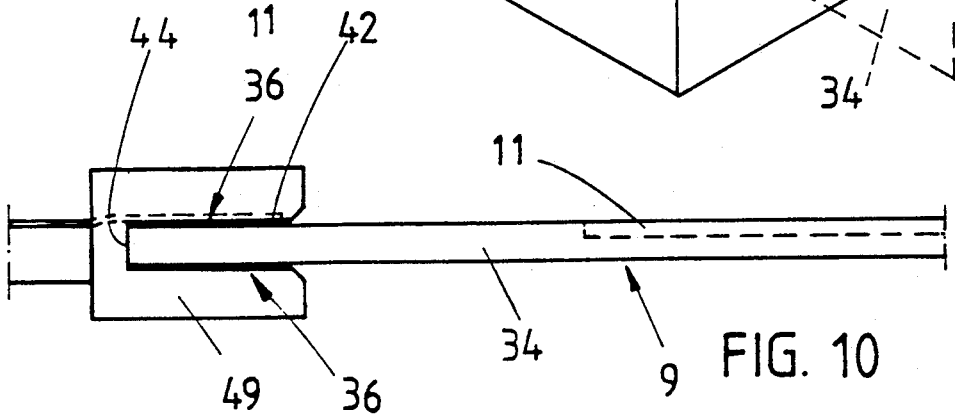
FIG. 10 is a view of the contact area of the inserted coupling element.

FIGS. 3, 4 and 5 show essential components of the lock construction. The lock 2 has a lock housing 20 in which a slide 21 is guided for longitudinal displacement, the slide resting with its slide surface 23 on an apertured plate 22 attached on the lock housing. The other side of the apertured plate 22 is covered by a cover plate 24 which forms one wall of the insert shaft 4. The second wall of the insert shaft 4 is formed by an armature plate 25 of ferromagnetic material which is pressed by a spring 26 against the cover plate 24. The slide 21 is held in its basic position (the position in accordance with FIG. 3) by means of a coil tension spring 27. In this basic position, aligned with the holes 28 of the perforated plate 22, there are bearing recesses 29 in which tumblers 31 developed as magnetic pins 30 are arranged for longitudinal displacement. At the lower end of the insert shaft 4, the slide 21 has a projection 32 against which the central region of a key-card 3 inserted into the insert shaft 4 or of an inserted coupling element 9 can strike. At least one of the bearing recesses 29 of the slide 22 is surrounded by a magnet coil 33. The magnet coil 33 is connected to the lock electronics 8. Furthermore, the card reader 6 extends up into the region of the insert shaft 4 and is also connected to the lock electronics 8 by a cable connection.

If a key-card 3 or a coupling element 9 having a valid key-card code 7 is now inserted into the insert shaft 4 of the lock 2, then the lower edge of the card comes first against the projection 32 of the slide 21. In this position, the magnetized regions 13 of the key-card 3 or coupling element 9 come to lie opposite the magnet pins 30 which were previously attracted by the armature plate 25 and accordingly rested with one partial region in the holes 28 of the apertured plate 22 and with another partial region in the bearing recesses 29 of the slide 21. This slide blocking is released in the manner that the magnetized regions 13 come to lie with identical poles opposite the magnet pins 30 so that the latter are pressed completely into the bearing recesses 29 and accordingly release the holes 28 of the apertured plate 22. The magnet pin 30 surrounded by the magnetic coil 3 is not moved into release position by a magnetized region 13 but is displaced due to excitation of the magnet coil 33. This is effected in the manner fact that the card reader 6 interrogates the bar code 14 —or at least a part thereof and compares the information read with the information in the memory 7' of the lock electronics 8. If there is agreement, the magnetic coil 33 is excited and the corresponding tumbler 31 is displaced. As a whole, therefore, the slide 21 is released and can be brought, by further insertion of the keycard 3 or of the coupling element 9, into the position shown in FIGS. 4 and 5 in which —in the case of a key-card 3 —a bolt displacement of the lock 2 is possible —by means of a mechanism not described in detail here —by actuating the actuating knob 5.

FIGS. 6 to 10 illustrate the possibility of introducing a special element into the insert shaft 4 of the lock 2 which establishes an electrical connection to the lock electronics whereby a mobile printer can be connected in order to have a listing of the contents of the lock memory 7' printed out. The special element, which is developed as coupling element 9, is shown in detail in FIGS. 6 to 8. It consists of a strip-shaped printed circuit board 34 which has a plastic substrate 35 and a conductive path coating 36. The conductive path coating 36 is covered by a film 37 for electrical insulation. It can be noted from FIG. 6 that a longitudinal extension 39 extends beyond the upper edge 38 of the coupling element 9, the longitudinal extension being arranged on one side of the longitudinal central plane 40. Conductive paths 41 of the conductive path coating 36 terminate in this longitudinal extension 39, whereby contacts 42 are formed. The arrangement is preferably developed in such a manner that both sides of the printed circuit board 34 are provided with a conductive path coating 36 in the region of the contacts 42, in connection with which contacting can take place through corresponding bored holes 43, as a result of which contacts 42 are formed on both sides of the printed circuit board 34. Via the conductive paths 41, the contacts 42 are connected to a multi-wire cable 45 the individual wires of which are soldered to the conductive paths 41 in the lower lateral edge region 46 (FIG. 6). Bored holes 47 can also be provided there for the attachment of a housing/handle section in which an additional electronic system may be arranged. The cable 45 leads to a mobile printer (not shown). On the side of the support 35 opposite the conductive path coating 36, the coupling element 9 has a recess 48 in which a coating substrate 11 is inserted, this coating substrate 11 corresponding to the coating substrate 11 of a key-card 3. It accordingly consists of a barium ferrite coating 12 and a film 19 which is transparent to infrared rays and bears on its inner side a printed bar code (bar code 14) (FIG. 8).

FIG. 9 again shows the lock 2 diagrammatically, the coupling element 9 being inserted into its insert shaft 4. It is evident in this connection that in the inserted condition with the slide displaced, the longitudinal extension 39 enters with its contacts 42 into a socket device 49 which has corresponding mating contacts which are connected to the lock electronics 8 (see also FIG. 10). Accordingly, the printer, which is connected by means of the coupling element 9, can print out a corresponding listing of the memory contents of the lock electronics 8. The arrangement can in this connection also preferably be developed in the manner that the bar code 14 of the coding substrate 11 of the coupling element 9 is read by the card reader 6 and has a corresponding coding which causes the lock electronics 8 to supply the data desired. If an invalid bar code is present, the lock electronics will block the data output. Furthermore, or as an alternative to this, it can also be provided that the displacement of the slide actuates a switch which only in its actuated position causes the electronics to effect the data output.

It is essential that the coupling element 9 can be inserted into the insert shaft 4 deep enough for the coupling with the socket device 49 only if the magnetized regions 1 of the barium ferrite coating 12 have a valid code, so that the tumblers 31 holding the slide 21 are displaced into the released position. If, furthermore, at least one of the tumblers 31 is provided with a magnet coil 33, then the coupling element 9 must also have a valid bar code 14 (or bar code part) so that, via the card reader 6, the lock electronics 8 can cause a control of the magnetic coil 33 in order to cause a releasing displacement of the corresponding tumbler 31. If the tumblers 31 release the slide 21, the latter can be brought into the position shown in FIGS. 4, 5 or 9, 10 in which a coupling of the contacts 42 with the socket device 49 takes place.

I claim:

1. An electronic locking device comprising lock and key-cards, the lock electronics of which has a data storage and which can be coupled with a data-retrieving mobile printer which can be connected to the lock electronics, the locking device having an insert shaft for the key cards in which a shaft card reader is arranged and which shaft is provided at its end with a socket connected to the lock electronics for a card-shaped coupling element of the printer which can be inserted into the insert shaft and has electric contacts, wherein the coupling element has a keycard code, a slide which can be displaced together with the coupling element by the insertion of the latter is present in the insert shaft, which slide can be fixed in position by tumblers which are moved into a release position in case of a valid key-card code and thus permit a displacement of the slide into its end position in which the contacts come into engagement with the socket device.

2. A locking device, according to claim 1, wherein the coupling element has a conductive path coating which forms the contacts on one lateral edge region of the coupling element, extends essentially up to the opposite lateral edge region of the coupling element while passing by the key-card code and is connected there to a cable which leads to the printer.

3. A locking device according to claim 1, wherein the contacts are arranged on a longitudinal extension of the coupling element.

4. A locking device, according to claim 1, wherein the longitudinal extension is formed on the side of the longitudinal central plane of the coupling element.

5. A locking device, according to claim 1, wherein the coupling element has a printed circuit board on one broad side of which a coding substrate of a key-card is arranged.

6. A locking device, according to claim 1, wherein the coding substrate rests in a recess in a broad side of the printed circuit board.

7. A locking device, according to claim 1, wherein the surface of the coding substrate is aligned with the surface of the printed circuit board.

8. A locking device, according to claim 1, wherein at least a part of the key-card code is formed by magnetized regions.

9. A locking device, according to claim 1, wherein a further part of the key-card code is formed by a code bar.

10. A locking device according to claim 1, wherein the bar code read by the card reader effects the control of that tumbler or those tumblers which can be brought into the release position by in each case one magnet coil which can be excited by the card reader.

11. A locking device, according to claim 1, wherein the slide has bearing recesses in its slide surface which rests of an apertured plate attached to the lock housing, tumblers 31 developed as magnet pins resting displaceably in said bearing recesses, and that the holes of the apertured plate are aligned with the bearing recesses in the basic position of the slide.

* * * * *